US010221624B2

(12) United States Patent
Leng

(10) Patent No.: US 10,221,624 B2
(45) Date of Patent: Mar. 5, 2019

(54) FOLDING LADDER HAVING CONNECTING HINGE

(71) Applicant: NEW-TEC INTEGRATION (XIAMEN) CO., LTD., Xiamen, Fujian (CN)

(72) Inventor: Luhao Leng, Xiamen (CN)

(73) Assignee: New-Tec Integration (Xiamen) Co., Ltd., Xiamen, Fujian (CN)

( * ) Notice: Subject to any disclaimer, the term of this patent is extended or adjusted under 35 U.S.C. 154(b) by 0 days.

(21) Appl. No.: 14/559,125

(22) Filed: Dec. 3, 2014

(65) Prior Publication Data

US 2015/0159434 A1 Jun. 11, 2015

(30) Foreign Application Priority Data

Dec. 5, 2013 (CN) ..... 2013 2 0797188 U

(51) Int. Cl.

| | |
|---|---|
| ***E06C 1/393*** | (2006.01) |
| ***E06C 7/50*** | (2006.01) |
| ***E06C 1/20*** | (2006.01) |
| *E06C 7/00* | (2006.01) |

(52) U.S. Cl.

CPC ..... *E06C 1/393* (2013.01); *E06C 1/20* (2013.01); *E06C 7/50* (2013.01); *E06C 7/00* (2013.01)

(58) Field of Classification Search

CPC ..... E06C 1/14; E06C 1/16; E06C 1/18; E06C 1/393; E06C 7/00; E06C 7/50; E06C 1/20

See application file for complete search history.

(56) References Cited

U.S. PATENT DOCUMENTS

| | | | | | |
|---|---|---|---|---|---|
| 4,485,892 | A * | 12/1984 | Maloney et al. | ..... | 182/161 |
| 5,722,507 | A * | 3/1998 | Kain | ..... | 182/129 |
| 6,012,548 | A * | 1/2000 | Kim | ..... | E06C 1/387 182/156 |
| 6,026,933 | A * | 2/2000 | King et al. | ..... | 182/165 |
| 6,427,805 | B1 * | 8/2002 | Gibson et al. | ..... | 182/165 |
| 6,550,579 | B2 * | 4/2003 | Gibson et al. | ..... | 182/161 |
| 6,902,035 | B2 * | 6/2005 | Baumgartner et al. | ..... | 182/165 |
| 7,849,967 | B2 * | 12/2010 | Gibson et al. | ..... | 182/176 |
| 7,967,111 | B2 * | 6/2011 | Meyers et al. | ..... | 182/129 |
| 2005/0029050 | A1 * | 2/2005 | Baumgartner | ..... | E06C 1/393 182/165 |

* cited by examiner

*Primary Examiner* — Colleen M Chavchavadze

(74) *Attorney, Agent, or Firm* — Edward E. Sowers; Brannon Sowers & Cracraft PC

(57) ABSTRACT

A ladder includes a rung, two front legs and two rear legs, the front portions at the two sides of the rung are respectively hinged to the two front legs, wherein a hinged connection element comprises a connecting rod and two connection pieces, two connecting pieces are symmetrically attached to the two ends of the connecting rod, each connecting piece comprises a hinged portion, a pivot portion and a fixation portion, the fixation portion is connected to the connecting rod, the hinged portion is hinged to the central portion of the side edge of the rung and to the rear leg, the connecting rod is supported on the bottom of the rung when the rung is unfolded. The connecting piece is hinged to the rung and the rear leg. The fixation portion is fixedly connected to the connecting rod, the connecting rod rotates when the rung is unfolded or folded.

7 Claims, 5 Drawing Sheets

FOLDING LADDER HAVING CONNECTING HINGE

FILED OF THE INVENTION

The present invention relates to a folding ladder having a connecting hinge.

BACKGROUND OF THE INVENTION

In daily use, a stool or a ladder is used to take objects at high place or to disassemble or assemble the electric apparatus at high place. The stool is not stable to stamp, it is dangerous. A ladder unable to fold up has large size, so that it is inconvenient for storage and moving. However, the rung of existing folding ladders is usually directly movably hinged to the front legs and the rear legs, thus making it not flexible to fold up, the rung may be locked during being folded or unfolded.

SUMMARY OF THE INVENTION

The present invention is provided with a connecting hinge of a folding ladder, which overcomes the disadvantages of the existing technology. The technical proposal of the present invention to solve the technical problems is that:

A folding ladder having a connecting hinge, the ladder comprising a rung, two front legs and two rear legs, two sides at front end of the rung are respectively hinged to the two front legs, wherein the connecting hinge comprises a connecting rod and two connecting pieces, two connecting pieces are symmetrically fixed to each end of the connecting rod, each connecting piece comprises a hinged portion, a pivot portion and a fixed portion, the fixed portion is connected to the connecting rod, the hinged portion is hinged to a central portion of the side edge of the rung, the hinged portion is hinged to a rear leg, the connecting rod supports on the bottom of the rung when the rung is unfolded.

In another preferred embodiment, the hinged portion and the pivot portion are each respectively disposed with a hinged hole.

In another preferred embodiment, the fixation portions are fixedly connected to the ends of the connecting rod.

In another preferred embodiment, the bottom of the rung is disposed with a lock catch, so that the lock catch is locked to the connecting rod when the rung is unfolded.

Compared to the existing technology, the technical proposal of the present invention has advantages as below:

1. the connecting piece is hinged to the rung and the rear leg, the distance from the hinged position of the rung and the front leg to the hinged position of the rung and the connecting piece is close, so that it is flexible when the rung is folded or unfolded, thus preventing the rung from locking.

2. the fixation portion is fixedly connected to the connecting rod, the connecting rod rotates when the rung is being unfolded or folded, the structure is much more stable.

3. the bottom of the rung is disposed with a lock catch, the lock catch is locked to the connecting rod when the ladder is unfolded, so that the ladder is safe and reliable.

BRIEF DESCRIPTION OF THE DRAWINGS

The present invention will be further described with the drawings and embodiments.

DETAILED DESCRIPTION OF THE EMBODIMENTS

Figure 1:
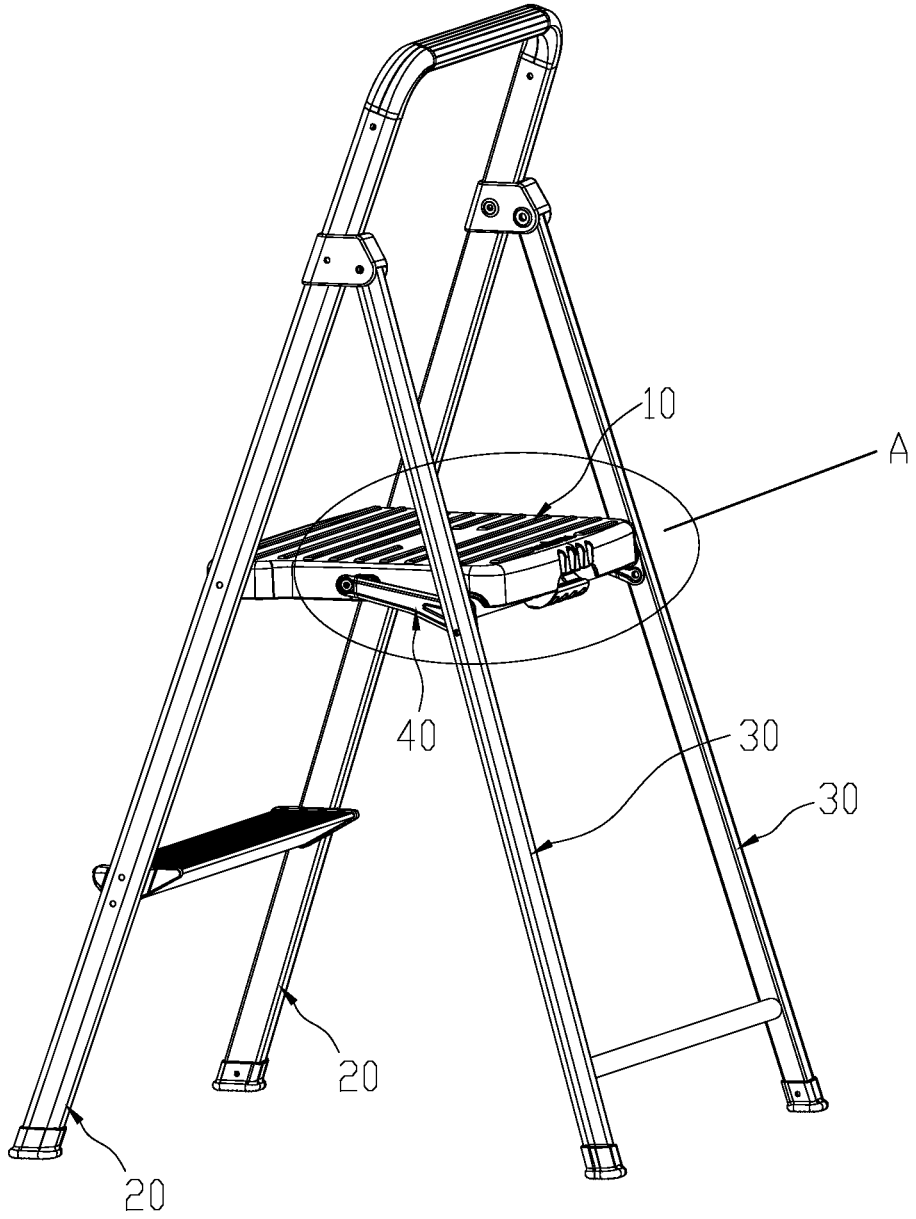
FIG. 1 illustrates a schematic diagram of a folding ladder of the present invention.
Figure 2:
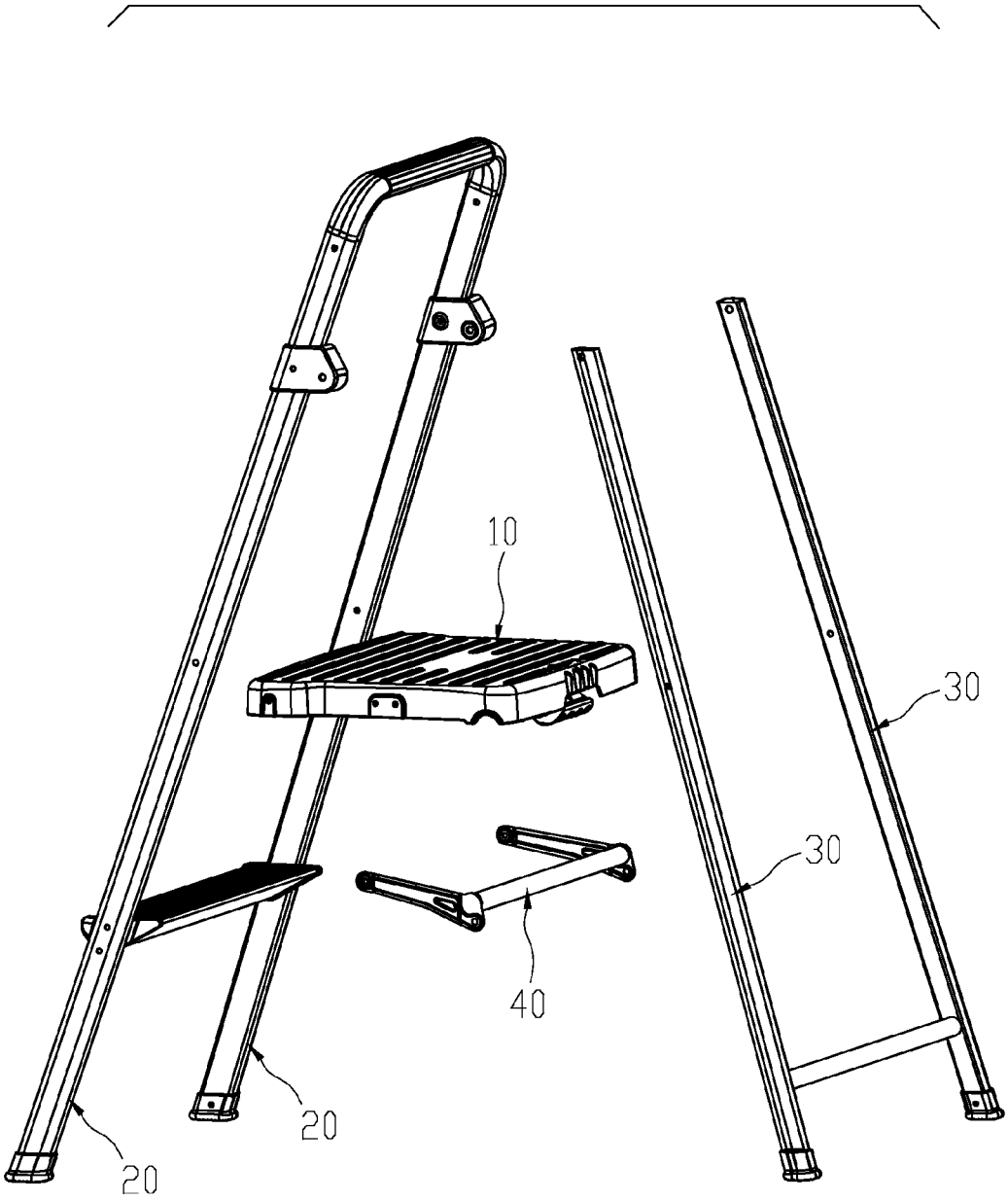
FIG. 2 illustrates an exploded and schematic diagram of the folding ladder of FIG. 1.

Please refer to FIG. 1 and FIG. 2, a folding ladder comprises a rung 10, two front legs 20, two rear legs 30 and a hinged connection element 40. The rear end of the bottom of the rung 10 is disposed with a lock catch 12. Two front legs 20 are parallel arranged. Two rear legs 30 are parallel arranged as well. Two rear legs 30 are respectively hinged to the two front legs 20. The front legs 20 and the rear legs 30 are applied with existing technology, so they are not described here. Also, referring to FIGS. 4 and 4A, rung 10 has a substantially planar surface 4, the planar surface includes a continuous and substantially linear edge 8 at the rear end.

Figure 3:
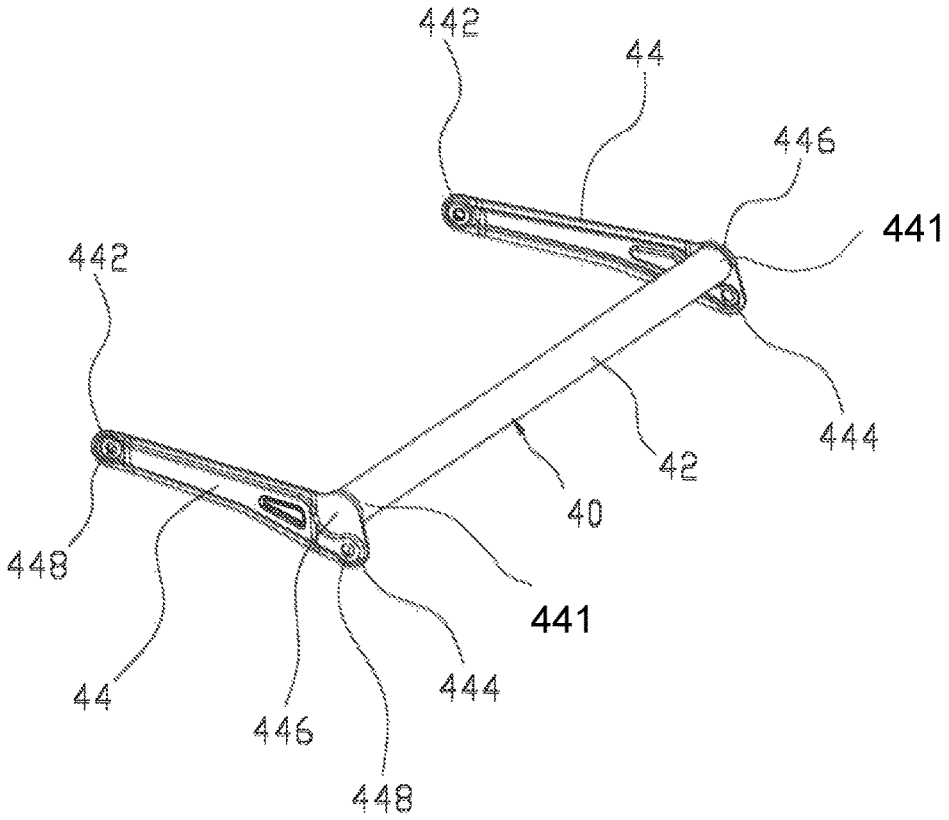
FIG. 3 illustrates a schematic diagram of a connecting hinge.

Please refer to FIG. 3, the connecting hinge 40 comprises a connecting rod 42 and two connecting pieces 44. The two connecting pieces 44 are symmetrically fixed to the two ends 441 of the connecting rod 42. Each connecting piece 44 comprises a hinged portion 442, a pivot portion 444 and a fixation portion 446. The hinged portion 442 and the pivot portion 444 are respectively disposed at the two ends of the connecting piece 44, the hinged portion 442 and the pivot portion 444 are respectively disposed with a hinged hole 448. The fixation portion 446 is disposed inclined above the pivot portion 444. The fixation portion 446 is fixedly attached to the connecting rod 42 by welding or locking or riveting.

Please refer to FIG. 1 to FIG. 3, the front portions of two sides of the rung 10 are respectively hinged to the two front legs 20; the hinged portions 42 of the two connecting piece 44 are respectively hinged to the central portions of the two sides of the rung 10; the pivot portions 444 of the two connecting pieces 44 are respectively hinged to the two rear legs 30.

Figure 4:
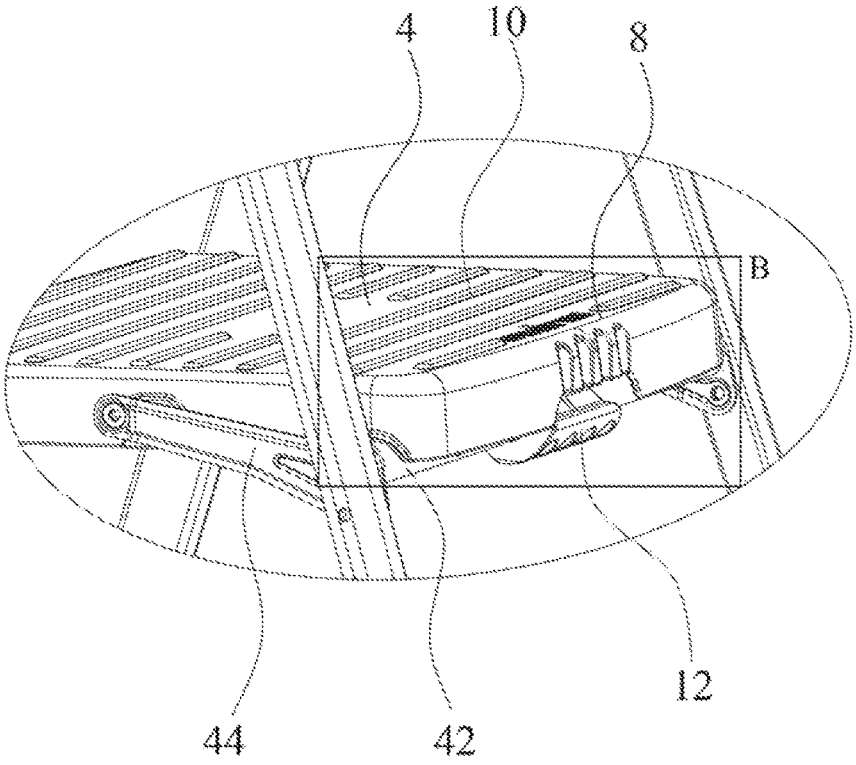
FIG. 4 illustrates an enlargement diagram of the A part of FIG. 1.
Figure 4A:
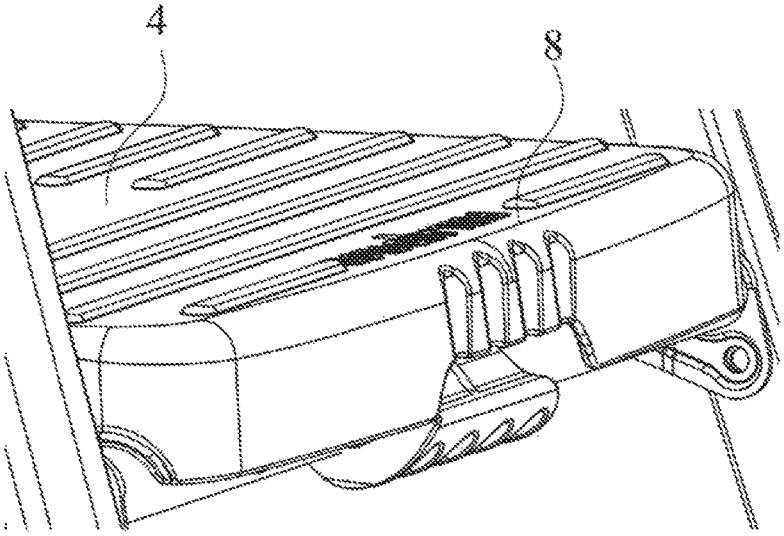
FIG. 4A illustrates a further enlargement of area B in FIG. 4.

Please refer to FIG. 4, when the rung 10 is unfolded, the connecting rod 42 supports the bottom of the rung 10, so that the ladder has more stable structure, moreover, the lock catch 12 is locked to the connecting rod 42, so that the ladder is used with safety.

Figure 5:
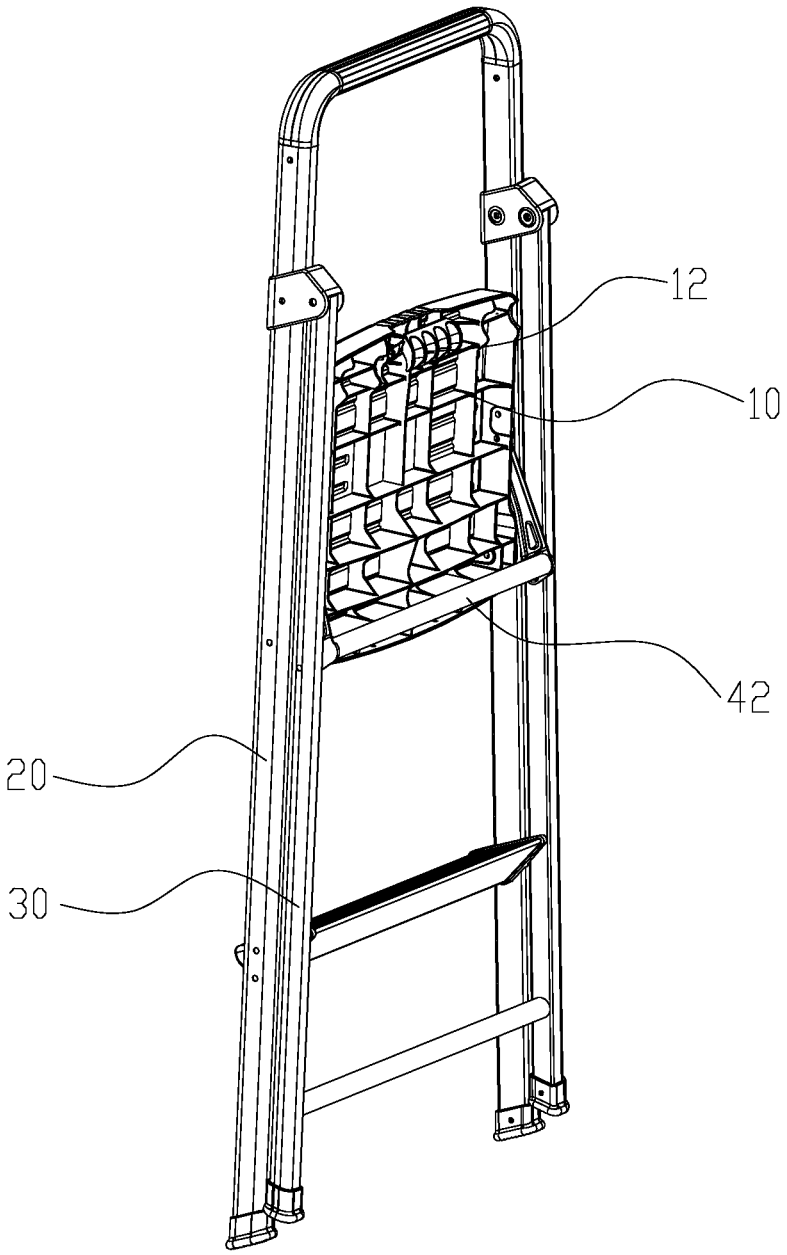
FIG. 5 illustrates a schematic diagram of the folded ladder.

Please refer to FIG. 5, when the rung 10 is folded, as the distance from the hinged portion 442 to the front leg 20 is short, it is labor saving to fold the ladder.

Please refer to FIGS. 3 and 4 illustrating the hinged connection element 40 having a U-shaped configuration comprising two connecting pieces 44 and a connecting rod 42 having opposing ends 441, each connecting piece having a first end or hinged portion 442 hinged to the opposite side edges of the rung 10 and a second end or pivot portion 444 fixed to the opposing ends of the connecting rod 441.

Please refer to FIGS. 1 and 4 illustrating the hinged connection element 40 hinged to and between the two rear legs 30.

Please refer to FIGS. 1 and 5 illustrating the folding ladder in a folded state (FIG. 5) and in an unfolded state (FIG. 1).

Please refer to FIGS. 1, 2, 3, 4 and 5 illustrating the hinged connection element 40 maintaining the U-shaped configuration in the folded state (FIG. 5) and in the unfolded state (FIG. 1), and the hinged connection element supporting the rung in the unfolded state (FIG. 1).

Please refer to FIGS. 1 and 4 illustrating the hinged connection element 40 hinged to and between the two rear legs 30 below the rung 10 in the unfolded state (FIG. 1).

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A folding ladder comprising:

two front legs;

a rung having a front end, a rear end, a first side edge, a second side edge and a surface, the front end hinged between the two front legs, the surface of the rung having a continuous and substantially linear edge at the rear end;

two rear legs hinged to the two front legs;

a hinged connection element comprising:

a connecting rod having a first end and a second end;

a first connecting piece and a second connecting piece, each of the first and second connecting pieces having a fixation portion, a pivot portion and a hinged portion;

the fixation portion of the first connecting piece being immovably fixed to the first end of the connecting rod, and the fixation portion of the second connecting piece being immovably fixed to the second end of the connecting rod;

the pivot portions connected respectively to the two rear legs, each of the pivot portions having a hinged hole; and the hinged portion of the first connecting piece being pivotally connected to the first side edge of the rung, and the hinged portion of the second connecting piece being pivotally connected to the second side edge of the rung, wherein the rear end of the rung rests on the connecting rod when the folding ladder is in an unfolded position, and wherein the first and second connecting pieces, the first and second fixation portions, and the connecting rod pivot simultaneously about the hinged holes of the pivot portions when the folding ladder transitions from the unfolded position to a folded position.

2. The folding ladder according to claim 1, wherein the hinged portion of the first connecting piece is pivotally connected to a central portion of the first side edge, and the hinged portion of the second connecting piece is pivotally connected to a central portion of the second side edge.

3. The folding ladder according to claim 1, wherein the rear end of the rung has a notch.

4. The folding ladder according to claim 3, wherein the notch is a concavity.

5. The folding ladder according to claim 3, wherein the notch abuts the connecting rod when the folding ladder is in the unfolded position.

6. The folding ladder according to claim 1, wherein the hinged portion has a hinged hole.

7. The folding ladder according to claim 1, further comprising a lock catch located entirely below the surface of the rung, the lock catch being locked to the connecting rod when the rung is unfolded.

* * * * *